United States Patent [19]

Jackson et al.

[11] 4,366,797

[45] Jan. 4, 1983

[54] VAPOROUS GASOLINE ASPIRATION SYSTEM AND FUMING TANK

[75] Inventors: Kenneth A. Jackson, Wooster; George I. Arndt, Loudonville, both of Ohio

[73] Assignee: V.G.A.S., Inc., Loudonville, Ohio

[21] Appl. No.: 151,170

[22] Filed: May 19, 1980

[51] Int. Cl.[3] ..... F02M 17/18

[52] U.S. Cl. ..... 123/523; 261/36 A; 261/119 A

[58] Field of Search ..... 123/522, 523, 524; 261/36 A, 119 A, 119 R, 79 R, 102, 104

[56] References Cited

U.S. PATENT DOCUMENTS

| | | | |
|---|---|---|---|
| 415,978 | 11/1889 | Regan | 123/522 |
| 474,838 | 5/1892 | Lambert | 123/522 |
| 890,970 | 6/1908 | Durr | 261/36 A |
| 993,516 | 5/1911 | Gentle | 261/79 R |
| 1,278,946 | 9/1918 | Langworthy | 123/522 |
| 1,403,848 | 1/1922 | Forrest | 123/522 |
| 1,809,531 | 6/1931 | Pogue | 261/36 A |
| 1,828,134 | 10/1931 | Fahrney | 261/36 A |
| 2,598,445 | 5/1952 | Schneider | 123/522 |
| 2,742,886 | 4/1956 | McPherson | 123/522 |
| 3,282,033 | 11/1966 | Seppanen | 123/522 |
| 3,931,801 | 1/1976 | Rose | 123/522 |
| 4,074,666 | 2/1978 | Pierce | 261/119 R |
| 4,196,710 | 4/1980 | Lehar | 123/523 |
| 4,271,809 | 6/1981 | Moore | 123/522 |

*Primary Examiner*—Ronald H. Lazarus

*Attorney, Agent, or Firm*—Baldwin, Egan, Walling & Fetzer

[57] ABSTRACT

A fuel system especially designed for use with an internal combustion engine or the like in which fuel system is operable therewith to provide fuel fumes or vapor to the engine from a source of liquid ignitable vaporizable fuel, such as gasoline, of sufficient quantity whereby to significantly increase the efficiency of the engine and thus substantially increase the per gallon mileage rate for the engine when used in an automotive vehicle or the like, and one using liquid fuel as the original fuel source. The system includes improved means for fuming the liquid fuel.

34 Claims, 10 Drawing Figures

VAPOROUS GASOLINE ASPIRATION SYSTEM AND FUMING TANK

This invention relates to a new and novel fuel system and more particularly to a fuel system especially designed for use with internal combustion engines or the like, and which fuel system is operable therewith to provide fuel fumes to the engine from a source of liquid ignitable vaporizable fuel, such as gasoline, and of sufficient quantity, whereby to significantly increase the efficiency of the engine, to thus substantially increase the per gallon mileage rate for the engine when used in an automotive vehicle or the like, and using the liquid fuel as an original fuel source.

BACKGROUND OF THE INVENTION

It is recognized in the art that the efficiency of the typical internal combustion engine in present use in automotive vehicles and the like is approximately twenty-five percent or less when using liquid fuel such as gasoline or other like ignitable fuels, such as for instance pentane, hexane, heptane, octane, nonane, decane, undecane, dodecane, tetra decane, hexadecane, octadecane, and crude oil.

Typical prior art fuel systems are exemplified in U.S. Pat. No. 3,749,376.

In the use of any such liquid fuel with an associated internal combustion engine it is well recognized that a substantial percentage of said fuel is not utilized by the engine for power generation, but instead is expelled from the engine and/or burned or consumed in the exhaust system thereof.

In applicant Kenneth A. Jackson's pending U.S. patent application, Ser. No. 129,345, filed Mar. 11, 1980 and entitled "Vaporous Gasoline Aspiration System," there is disclosed a novel fuel system which will materially increase the efficiency of an internal combustion engine, and the prior art identified therein is incorporated herein, without specifically listing the same. The present invention is an improvement of a system of the general type disclosed in Ser. No. 129,345.

BRIEF DESCRIPTION OF THE INVENTION

Briefly, the invention provides a fuel system for use with an internal combustion engine or the like wherein fuel fumes are generated from a liquid source of ignitable fuel such as gasoline, or similar liquid vaporizable fuel, and presented in a fumed state to the engine for consumption and power conversion therein, and wherein the system is provided with improved means for fuming the liquid fuel.

Novel arrangements of fume tanks are disclosed for use in the fuel system.

Substantially all of the fumed fuel presented to the engine is consumed therein for power conversion, thus resulting in substantially increasing the efficiency of the engine and hence substantially increasing the mileage rate per gallon of liquid fuel.

In actual testing of one embodiment of system incorporating the present invention with an internal combustion engine in an automobile, the mileage rate obtained per gallon with liquid leaded gasoline as the source of ignitable fuel, has been of the order of at least 400 percent greater than that which has been heretofore obtainable using liquid gasoline which is directly burnable in the engine.

For example, testing of the present system has been undertaken with a 1975 Cadallic wherein the mileage rate per U.S. gallon of fuel obtained has been in the magnitude of 45–48 miles per gallon with liquid leaded gasoline as the fuel source.

It is, therefore, a primary object of the present invention to provide a fuel system especially designed for use with an internal combustion engine utilizing liquid ignitable fuel as the fuel source, and wherein the fuel system is operable to generate fuel fumes from said liquid fuel and to provide a sufficient quantity of the same to the engine, so as to substantially increase the operating efficiency of the engine.

Another object of the invention is to provide a fuel system especially designed for use with an internal combustion engine of an automotive vehicle adapted to utilize liquid ignitable fuel and which system is operable to generate fuel fumes in an improved manner from the liquid fuel, and to provide fumes of sufficient quantity to the engine, whereby to significantly increase the efficiency of the engine, to thus substantially increase the automotive vehicle per gallon mileage rate of the liquid fuel.

Still another object of the present invention is to provide a fuel system as hereinabove referred to which is operable at atmospheric pressure and which utilizes the vacuum or suction generated by the engine, to provide the fuel fumes to the engine.

Another object of the present invention is the provision of a fuel system a hereinabove referred to and which is substantially easily adapted for use with an internal combustion engine.

Another object of the invention is to provide a fuel system of the type hereinabove referred to and which utilizes the vacuum of the internal combustion engine to supply fumed fuel to the engine, and wherein the system includes a novel auxiliary or fume tank in conjunction with the main fuel tank, for improving the fuming of the liquid fuel.

A still further object of the invention is to provide a fuel system in accordance with the above, which includes improved means for fuming the liquid fuel.

A still further object of the invention is to provide a fuel system in accordance with the foregoing wherein arcuate diffusing vanes are provided in conjunction with baffle structure, for aiding in removal of liquid droplets of fuel from the fuel-air mixture adapted to be supplied to the engine.

A further object is to provide novel arrangements of fume tanks for assembly with the conventional main liquid fuel tank of an automotive vehicle, for materially increasing the operating efficiency of the engine of the vehicle.

Other objects and advantages of the invention will be apparent upon reference to the following description taken in conjunction with the accompanying drawings, which illustrate preferred embodiments thereof.

BRIEF DESCRIPTION OF PREFERRED EMBODIMENT

The fuel system of this invention provides fumed fuel from a source of liquid fuel such as gasoline or like liquid ignitable fuel, many of which are hereinabove referred to, to an internal combustion engine.

As one preferred embodiment, it is herein described, for use with an automobile wherein "fumed gasoline fuel" is generated in an auxiliary or fume tank, which coacts with a main liquid fuel tank, and is mixed with air, and then supplied to the carburetor of the engine, for powering the latter. The fume tank is controllably vented or connected to atmosphere, to provide suitable quantities of air for fuming and mixing with the vaporous fuel, and improved means are provided for accomplishing the fuming of the liquid fuel.

BRIEF DESCRIPTION OF THE DRAWINGS

FIG. 10 is an enlarged view of an auxiliary or fume tank generally similar to that of FIG. 6, but illustrating a further embodiment of fume tank which includes means for further aiding in vaporizing the liquid fuel and in removing droplets of liquid fuel from the fumed air-fuel mixture prior to its passing from the fume tank.

DESCRIPTION OF PREFERRED EMBODIMENTS

While the fuel systems illustrated are particularly adapted for use with an internal combustion engine in an automotive vehicle type of environment, it is also contemplated that said system may be adaptable to an internal combustion engine in varied environments such as tractors, stationary power units, off-the-road equipment, and the like.

Figure 1:
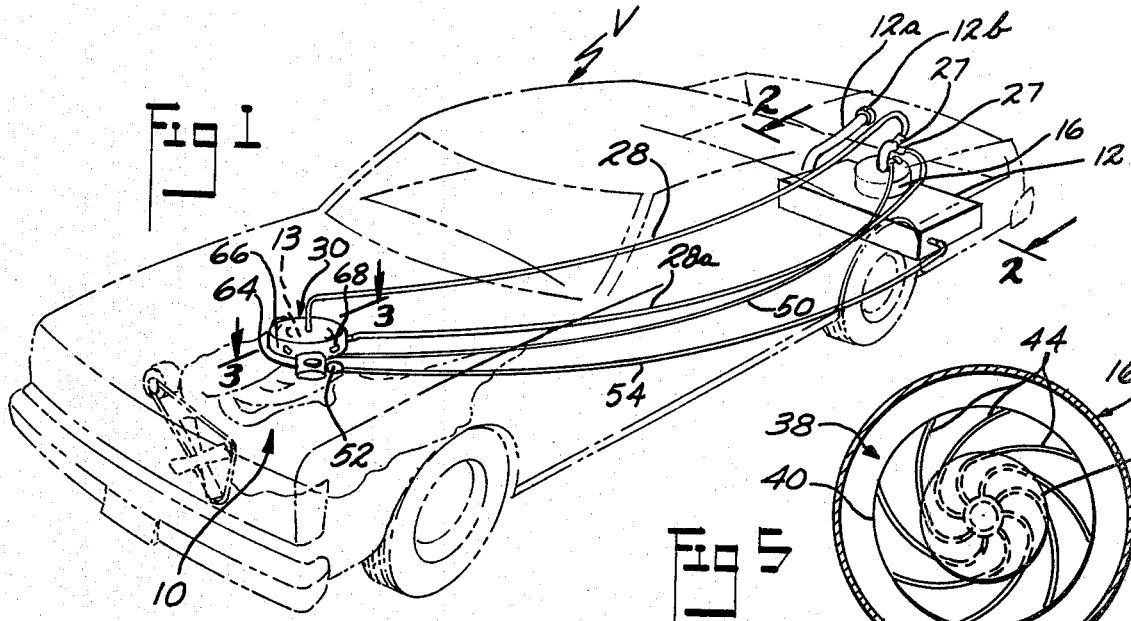
FIG. 1 is a perspective view illustrating a typical automobile in phantom, with the fuel system of the present invention interconnected between the tank containing the liquid fuel and the carburetor of the engine.

As herein illustrated, a typical automobile vehicle V is shown in FIG. 1 equipped with an internal combustion engine 10 designed to burn liquid ignitable fuel supplied by a more or less conventional fuel tank (e.g. tank 12 having liquid fuel inlet 12*a* and conventional vented cap 12*b*) for providing liquid fuel such as gasoline or any other liquid vaporizable ignitable fuel, to the carburetor 13 of said engine.

As aforementioned, with the fuel such as gasoline being supplied to the engine 10 in its liquid state, the engine only uses about 25–30 percent of said fuel for power conversion whereby the major part of said fuel is wasted and emitted in various well known pollutant forms from said engine.

As aforementioned, the fuel system of the present invention overcomes this deficiency by providing ignitable fuel in its "fumed state" such that substantially all of the delivered fuel to said engine is utilized for power conversion.

To accomplish this, a fuel fume tank or auxiliary tank identified at 16 which is generally cylindrical in its present configuration, coacts in the upright position with the conventional fuel tank 12 located below the trunk space 18 (FIG. 2) of the vehicle, and with its (member 16) lower end projecting into the interior of tank 12, so as to be disposed in submerged relation with the anticipated level 19 of liquid fuel in main tank 12. Tank 16 in the embodiment illustrated comprises top wall 20, side wall portion 20*a* and bottom wall 20*b*, with such bottom wall, in the embodiment illustrated having a plurality of openings 22 therein. thus communicating the interior of tank 16 with the interior of main tank 12, and thus establishing the liquid fuel level in tank 16 at substantially the same level as that of the liquid fuel in main tank 12. Tank 16 is received in the complementary opening 23 formed in the top wall of main tank 12 in sealed relation, either by adequate gasketing means or by permanent welds securing tank 16 to tank 12.

In its present configuration, tank 16 is about 16" in its external diameter, to define a fume chamber 16*a* therein.

One end of a collector member or tube 24 is secured as at 24*a* by any suitable means, such as, for instance, welds, to the top wall 20 (in the embodiment illustrated) of the auxiliary or fuming tank 16, with such member 24 projecting interiorly of the fuming tank 16, and being open at its bottommost end, for passage of fumed fuel-air mixture thereinto from the fuming tank.

Figure 2:
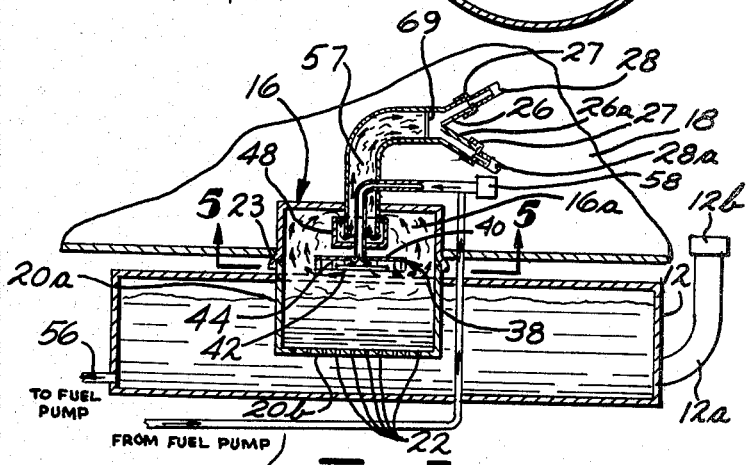
FIG. 2 is a view taken generally along the plane of line 2—2 of FIG. 1 and illustrates in section the rear trunk area of the automobile and the main gasoline tank located therebelow, with the auxiliary or fume tank projecting upwardly from the main tank and extending into the trunk space.

Member 24, in the embodiment illustrated, is of arcuate configuration in side elevation, as can be best seen in FIG. 2, and at its distal end comprises a pair of branch conduit sections 26, 26*a*, which have coupling means 27 coacting therewith such as, for instance, threaded coupling means, for coupling member 24 to a respective line 28, 28*a*.

Line 28 is directed to the carburetor 13 passing through a tight fitting opening in the conventional air cleaner housing 30 mounted on the carburetor, and with line 28 terminating just above the conventional butterfly valve 32 located in the carburetor throat, thereby providing for passage of fumed fuel-air mixture from the collector member 24 to the carburetor. Line 28*a* passes from the collector 24 to coupling 34, mounted to the conventional air cleaner housing 30, thereby providing a further passage for the transmission of additional fumed fuel-air from the collector 24 to the carburetor.

Collector tube 24 in the specific embodiment illustrated, is preferably approximately three inches in internal diameter, while supply line 28 has an internal diameter of preferably approximately $1\frac{1}{2}$", and line 28*a* has a corresponding diameter of approximately $\frac{3}{4}$". Such lines 28, 28*a* are capable of providing sufficient fumes to carburetor 13 for powering the engine.

Extending from exteriorly of collector member 24 and passing through the wall thereof in sealed relationship, is an air inlet conduit 36, which extends downwardly through the downwardly extending collector pipe 24 below open end thereof, with pipe 36 having a diffuser member 38 secured thereto just above the level 19 of liquid fuel in auxiliary or fuming tank 16.

Diffuser member 38, in the embodiment illustrated, comprises an upper plate 40 and a lower plate 42 (FIG. 5) with the distal end of air inlet pipe 36 being disposed in vertically spaced relation above the lower plate 42 so that as air (and also fuel as will be hereinafter described) passes downwardly through the pipe 36, it impinges against the upper surface of lower plate 42. Extending generally radially outwardly from the vertical axis of plate 42 commencing generally adjacent the periphery of lower plate 42, are a plurality of arcuate vanes 44 so that the air and fuel passing into diffusing member 38 is twirled or given a vortex effect as it streams outwardly through the diffusing member 38 and across the confronting surface of the liquid fuel in auxiliary tank 16, thus fuming the fuel and creating a relatively rich mixture of fuel and air, which is then drawn upwardly by the engine vacuum, as will be hereinafter discussed.

As the fumed fuel-air mixture is drawn upwardly in chamber 16*a* of fume tank 16, it passes through a baffle arrangement 48, which may be supported on aforementioned inlet pipe 36, such baffle comprising a cup-like member 48*a* which opens upwardly so that the fumed fuel-air vapor has to pass upwardly over the open top of the cup-shaped baffle and then downwardly to pass into the lower open mouth of collector member 24, and aiding in removal of any liquid droplets of fuel from the fumed fuel-air mixture.

Figure 4:
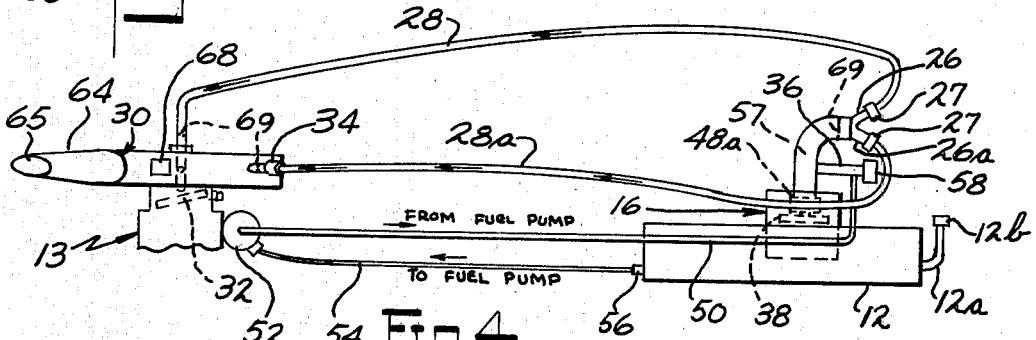
FIG. 4 is a generally diagrammatic elevational view of the fuel system of the invention connecting the carburetor of the vehicle engine with the source of liquid fuel.

Air inlet pipe 36 preferably has an interior diameter of approximately one inch. Branching off from air inlet pipe 36 and in communication therewith is a liquid fuel pipe or conduit 50 of conventional internal diameter size coming from the output port of the conventional fuel pump 52 (FIG. 4) of the conventional internal combustion engine 10. The input port of the fuel pump 52 is connected by means of conventional conduit line 54 (FIGS. 1 and 4) to the conventional outlet port 56 on the main fuel tank 12. Fuel lines 50 and 54 preferably have an internal diameter in the embodiment illustrated of approximately $\frac{3}{8}$".

A shower head or liquid diffusing screen 57 of conventional known type may be provided either at the connection of fuel line 50 to air inlet line 36, or in the alternative at the distal end of air inlet line 36, so that the liquid fuel as it is mixed with the air being inserted into the diffuser member 38 via line 36, is broken into a fine mist, thus facilitating the fuming of the liquid fuel and enriching the fuel-air mixture with fumes of the liquid fuel as compared with liquid fuel droplets. The impacting of the lower plate 42 in diffuser 38, by the fuel-air mixture emanating from the distal end of inlet line 36 likewise aids in the removal of liquid droplets from the fuel-air mixture.

A conventional, normally closed, air check valve 58 (FIGS. 2 and 4) coacts with the air inlet line 36 and is intended to be actuated to its open condition in response to the pressure in the fuming tank 16 reaching a negative pressure (vacuum) of approximately minus one pound of mercury as read on a conventional automotive vacuum gage, thus connecting the interior of the fuming tank 16 through the air inlet pipe 36 to atmosphere. In actual practice this magnitude of negative pressure (vacuum) is substantially immediately realized upon the engine 10 being initially actuated or "turned over" as is referred to in the art.

Figure 3:
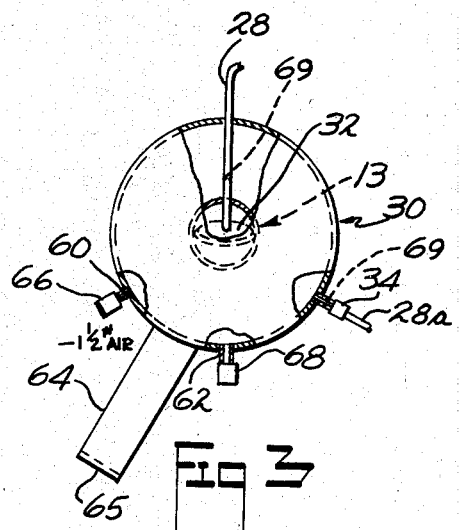
FIG. 3 is a view looking along the plane of line 3—3 of FIG. 1 showing a partially broken, enlarged plan view of the carburetor and associated air cleaner housing, and of connections thereto, as embodied in the fuel system of the present invention.

Referring now to FIG. 3, the circular wall of the air filter housing member 30 is provided with two air entry ports 60 and 62 respectively. The conventional air intake chute 64 on the air cleaner is blocked, as at 65, so that air cannot be drawn thereinto as is conventionally done with an internal combustion engine. Port 60 is connected to a normally closed conventional air check valve 66, while port 62 is coupled to a normally closed conventional air check valve 68. Valve 66 is adapted to open in response to pressure in the throat of the carburetor reaching a negative pressure (vacuum) of approximately one and one-half pounds of mercury, thus coupling the closed air cleaner housing to the exterior air shortly after the engine is "turned over" or actuated, thus "leaning out" the fuel-air mixture of fumed fuel being supplied via lines 28, 28*a* to the carburetor. Air check valve 68 is adapted to open when the pressure in the carburetor throat reaches a negative pressure (vacuum) of approximately a minus five pounds of mercury, thus furnishing further outside or atmospheric air to the carburetor. In actual practice this magnitude of negative vacuum of a minus five pounds is reached when the engine is at approximately its idle operating condition.

In operation the fume fuel system of the FIGS. 1 through 5 system is preferably as follows:

Assuming that the engine 10 is off, or at rest condition, a certain quantity of fuel fumes is being generated in the fuming tank 16 due strictly to the fact that there is liquid fuel therein. In this rest condition) the air check valves 58, 66 and 68 are in closed condition, and the butterfly valve 32 in the carburetor throat is likewise in generally closed position.

When the engine is turned over either manually, or by the typical battery-powered starter used in conventional present-day automotive systems, the initial cranking of the engine will generate a vacuum in the fuming tank 16 and in the air inlet pipe 36 as well as in the engine manifold, and in carburetor 13, when the butterfly valve 32 is opened through the conventional foot control accelerator or throttle (not shown), or by any other means, thus causing the vacuum to go to about minus one pound of mercury in the carburetor as well as in the lines 28, 28*a* and in the aforementioned fuming tank 16 and air inlet 36, and thus resulting in the air check valve 58 to outside air, permitting air from atmosphere to flow into inlet pipe 36. At the same time, the cranking of the engine causes the fuel pump 52 to pump liquid fuel via fuel line 50 into air inlet pipe 36 through the misting connection 57, thereof, thereby supplying a combined fuel-air mixture to the diffuser member 38, whereupon the fuel mixture whirls in cyclonic fashion outwardly from the center of the lower baffle, or abutment plate 42, to pass across the surface of the liquid fuel in auxiliary tank 16 upwardly past the baffle arrangement 48, and into the open bottom end of the collector tube 24.

The cyclonic, or whirling effect of the diffuser 38 aids in elimination of liquid droplets from the fuel-air mixture abutting against the abutment plate 42, thereby maintaining the fuel-air mixture being supplied to the engine in vaporous condition, as well as enhancing the vaporization of the liquid fuel. Such fuel-air mixture, passing upwardly through the baffle 48, likewise aids in removal of any liquid droplets in the fuel-air mixture to further aid in increasing the efficiency of the engine.

From collector chamber 24, the fuel may pass through the fuel supply lines 28, 28*a* to the carburetor, whereupon the fuel in the piston firing chambers of the engine 10 is ignited, to cause the engine to fire. As the comparatively rich fuel-air vaporous mixture is passed into the carburetor, due to the vacuum caused by cranking the engine, the atmospheric air inlet check valve 66 opens to mix further at approximately a minus one and one-half pounds of mercury, to "lean" out the fuel as it passes through the throat of the carburetor to the piston chambers.

Upon firing of the engine, the atmospheric air check valve 68 opens at approximately a minus five pounds vacuum of mercury, to further lean out the comparatively rich vapor being furnished to the carburetor via lines 28, 28*a*, and the engine is then available to power the vehicle V. Safety screening, such as for instance miner's screen, are preferably provided as at 69 in collection chamber 24 and in supply lines 28, 28*a* at their connections to the air filter housing 30, to extinguish any flame in the event of back firing of the engine.

It will be seen that the system of FIGS. 1 through 5 is a closed system, with outside atmospheric air being admitted to the system only upon opening of the air check valve 58 which occurs upon cranking of the engine. As the negative pressure or vacuum increases toward a minus five pounds of mercury, the quantity of fumed fuel-air mixture that is drawn from the fuming tank 16 into the collector tube or member 24 and then through lines 28, 28*a* to the carburetor, increases proportionately, thus providing an adequate source of the vaporous fuel-air mixture to the engine. When the engine is shut off by turning off the key thereto, the air check valves 58, 66 and 68 close, and the butterfly valve 32 is returned to its closed position, thus causing the pressure in the carburetor to return to approximately zero magnitude, thus stopping any ingress of atmospheric air into the system. It will be understood that in the present system wherein only a fumed fuel and air mixture is provided to the engine for combustion, substantially all of the fuel-air mixture is burned for power conversion, thus resulting in substantially increasing the efficiency of the engine, and for automotive type vehicles, such system is operable to substantially increase the vehicle mileage rate per gallon of liquid fuel that is utilized in the fuel tank.

Figure 5:
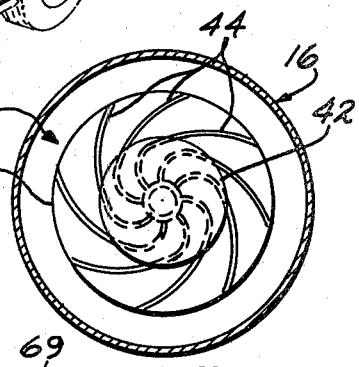
FIG. 5 is an enlarged, sectional view taken generally along the plane of line 5—5 of FIG. 2, looking in the direction of the arrows, and illustrating the underside of the diffuser mechanism in the auxiliary or fume tank of the system.
Figure 6:
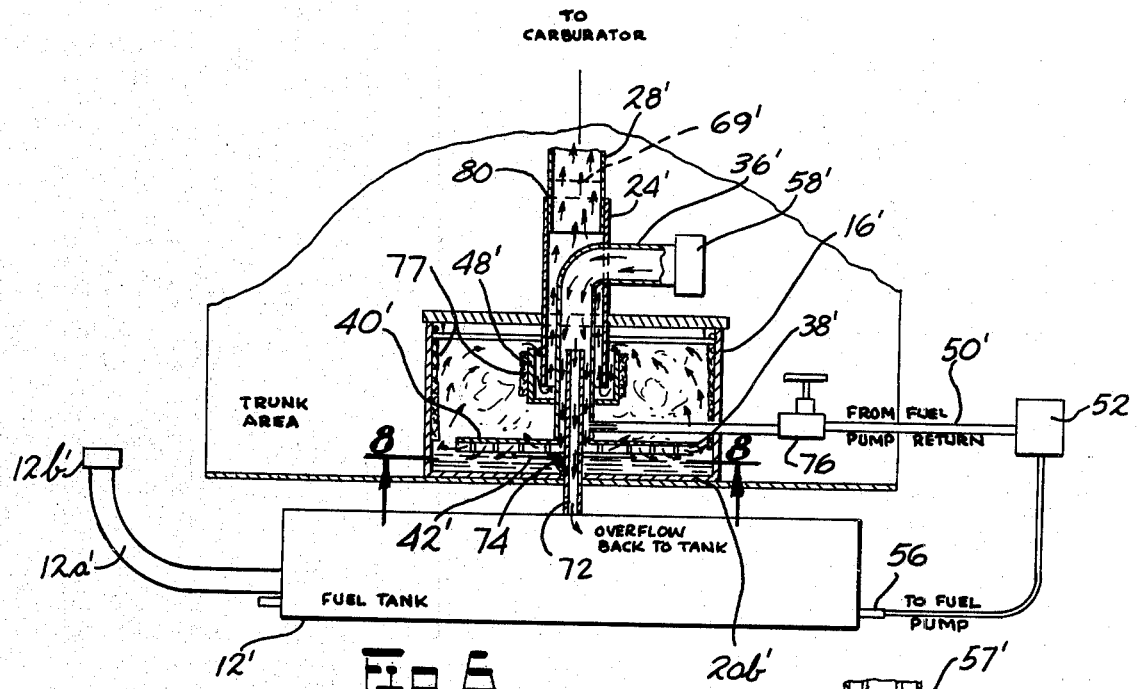
FIG. 6 is a sectional view generally similar to FIG. 2, but illustrating another embodiment of system especially as concerns the auxiliary or fume tank and associated main liquid fuel tank.
Figure 7:
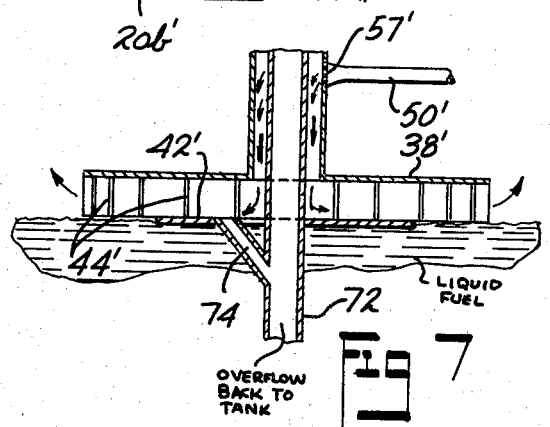
FIG. 7 is an enlarged detail view of the auxiliary tank of FIG. 6 illustrating an overflow arrangement.
Figure 8:
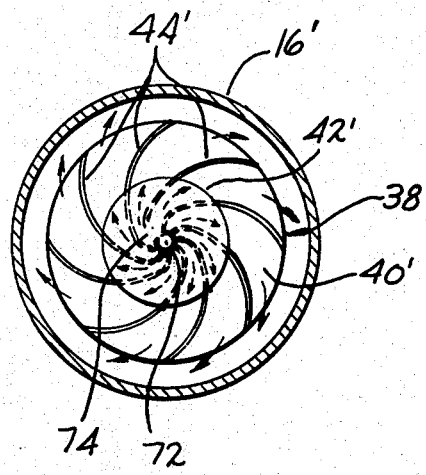
FIG. 8 is a view generally similar to FIG. 5, but taken along the plane of line 8—8 of FIG. 6.

Referring now to FIGS. 5 through 7, there is shown another embodiment of fuming tank arrangement. In this embodiment, the fuming tank is more readily connectable to an existing main fuel tank without substantial alteration of the latter and an overflow arrangement is provided for causing fuel inserted into the air inlet line to be returned to the main tank when it gets to a predetermined level in the auxiliary fuming tank. In this arrangement, like reference numbers have been utilized when referring to the component parts thereof, except that the prefix prime (') has been added thereto.

In this arrangement, the auxiliary fuming tank 16' includes a non-perforated bottom wall 20*b'*, but which has a pipe or conduit member 72 extending through such bottom wall 20*b'* in sealed relation therewith, and which extends downwardly to communicate at its lower end with the interior of the main fuel tank 12' of the vehicle. Coacting with upright pipe 72 is an overflow pipe section 74 which branches off from pipe 72 and extends a predetermined distance above the bottom surface of the auxiliary tank 16' and in this embodiment opens onto the upper surface of bottom baffle plate 42 of diffuser member 38'. Thus it will be seen that in the event that the fuel level in auxiliary tank 16' gets up to the entry mouth pipe 74, the fuel flows down through branch pipe 74, through pipe 72 to the interior of main fuel tank 12'.

The air inlet pipe 36' in this embodiment extends from exteriorly of the collector pipe or member 24' through the wall thereof in sealed relationship and extends downwardly to terminate at the upper plate member 40' of diffuser member 38'. In other respects, the diffuser member 38' is generally similar to that aforediscussed in connection with diffuser member 38 of the firstdescribed embodiment. The air inlet pipe 36' has a conventional air check valve 58' coacting therewith in a similar manner as the corresponding air check valve in the first-described embodiment. In this embodiment, the fuel line 50' from the fuel pump 52 preferably has a manually actuatable shut-off valve 76 therein, and with such fuel line extending into the air inlet pipe 36' just above the diffuser member 38', a liquid misting screen or head 57' is preferably utilized at the entry end of line 50' into air inlet line 36' and in a generally similar manner as in the first described embodiment.

In this embodiment, the collector member 24' coacts with a single transmission line 28', in the embodiment as illustrated. Line 28' is preferably approximately two inches in internal diameter and connected to collector 24' in sealed relationship and as at 80. Line 28' is then coupled to the carburetor preferably in a generally similar manner as the coupling of line 28 in the first-described embodiment. This single transmission line 28' takes the place of the two substantially smaller lines 28, 28*a* in the first described embodiment.

In this embodiment of fuming tank 16', the interior of the side walls thereof may be covered with a liquid absorbent material, such as at 77, impervious to the action of the fuel, for aiding in removal of liquid droplets from the fumed air-fuel mixture being dispersed from the diffuser member 38' to the interior of the fuming tank 16' prior to its passage through the baffle member 48' and entry thereof into the collection member 24'. A suitable material for such droplet absorbing member has been found to be non-woven fabric in the form of carpeting of polyester, or nylon, or the like.

Referring now to FIG. 10, there is shown a further embodiment of auxiliary or fume tank which is somewhat similar to the fume tank embodiments illustrated in the previous embodiments of FIG. 2 and FIG. 6 respectively, but which includes thereon on the interior of the tank a greater amount of the liquid absorbent material 77" shown in FIG. 6 embodiment. Moreover, in this embodiment, the diffuser member 38" is somewhat different from the diffuser members of the first-described embodiments, and a different arrangement is provided for passing of the overflow of liquid fuel in the fume tank back to the main fuel tank. Like numbers have been utilized to designate generally similar parts except that the prefix " has been added thereto.

As can be seen from FIG. 10, the bottom plate 42" of the diffuser assembly 38" is the larger of the plates, with the top plate 40" providing the bottom of the cup baffle 48". The vanes 44" commence adjacent to the axial center of the plates 40", 42" and are arcuate in a generally similar manner as in the first-described embodiments, for causing a whirling of the inlet fuel and air mixture as it strikes the bottom plate when it emerges from the distal end of the inlet pipe 36".

Bottom plate 42'' extends almost completely across the dimension of the fuming tank 16'' and terminates just short of the side walls thereof and as at 80. The top plate 40'' of the diffuser 38'' preferably terminates just short of (approximately ½ inch) of the fabric covered side walls of tank 16''.

The aforementioned fabric material 77'' covers not only the interior surfaces of the side walls of the fuming tank, but also the interior surfaces of the top wall as well as the side and interior bottom surfaces of the baffle member 48'' and also the exterior of the collector member 24'' where it extends into the fuming tank 16''. Accordingly, the fuel-air mixture passing through the diffuser up over the baffle member 48'' and then downwardly into the cup-like baffle to enter the lower open end of the collector 24'' is passed by or exposed to a substantial amount of the fabric 77'', thus removing substantially all of any liquid droplets in the fuel-air mixture to maintain maximum efficiency for powering the engine. It will be seen that the lower end of the fabric material on the side walls of the fuming tank extend downwardly as at 82, below the lower plate 42'' of the diffuser 38'' and into the pool of liquid fuel which ordinarily is found therein. Liquid fuel by the "wicking" action of the fabric is drawn upwardly into the fabric covering the side walls and the top wall, wetting the latter with liquid fuel, and thus aids in fuming the fuel-air mixture. A funnel member 83 is provided through plate 42'' in general alignment with inlet pipe 36'' so that some fuel-air mixture from pipe 36'' passes through lower plate 42''.

A sight tube 84 may be provided on the exterior of the fuming tank for indicating the level of liquid fuel therein.

A housing member 86 is provided over the drain port 88, which is connected as by means of a drain line 90 to the main fuel tank (not shown), and if the level of liquid in chamber 89 gets above the level illustrated, it will overflow housing 86 and then flow down through openings 92 in enclosure 86 and out the drain 88 to the main fuel tank. Expansion chamber 93 may be provided in line 90.

The upper end of the collector member 24'' is reduced from the approximately three inch diameter of the vertical portion thereof down to approximately one and seven-eighths inch diameter where it is connected to the feed line 28'', which is directed to the carburetor. As can be seen, an expansion chamber 93' may be provided in line 28'', and also a drain 94 may be provided in line 28'' and connected by line 96 back to line 90 to the main fuel tank, for further removal of any liquid fuel that may still exist in the fuel-air mixture being fed to the carburetor by the vacuum pressure.

Line 28'' is preferably approximately one and one-half inches in internal diameter. Operation of this embodiment of fuming tank is generally similar as that described for the previous embodiments, except that due to the coating material, or fabric 77'', the fuel-air mixture is further enriched with vapor emitted from coating 77'', and thus is maintained in an even greater magnitude of vaporous condition.

Figure 9:
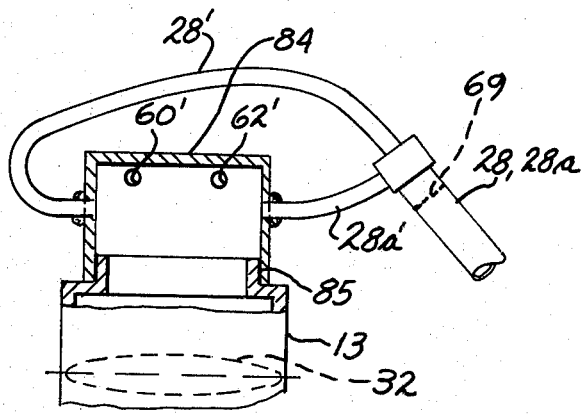
FIG. 9 is a vertical, sectional enlarged view of another embodiment illustrating a cap rather than an air filter housing, for use with a conventional internal combustion engine carburetor, for controlling the air intake of the carburetor during the supplying of fumed fuel thereto from an auxiliary or fume tank system of the type of FIG. 2 or of the type of FIG. 6.
Figure 1:
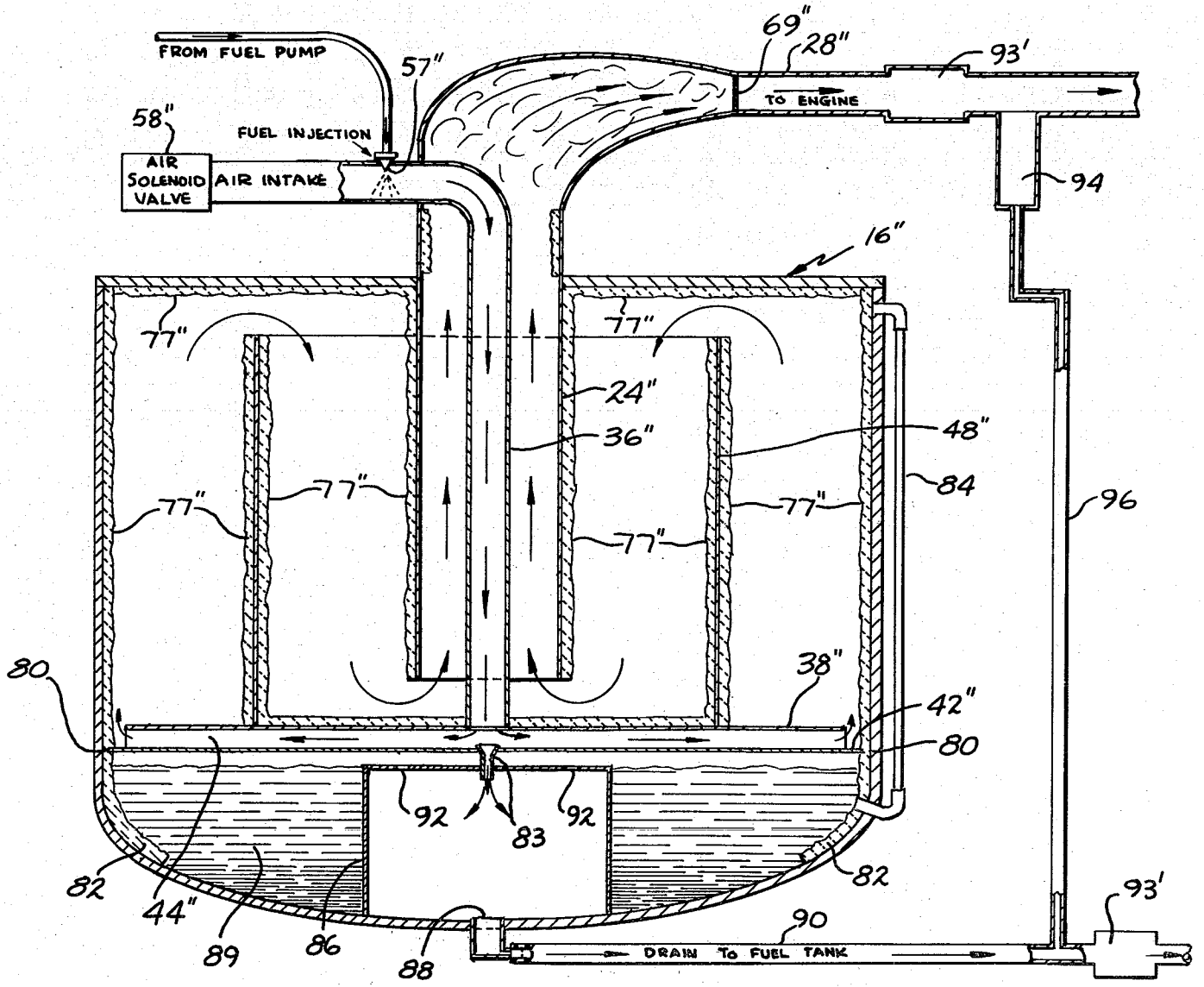

Referring now to FIG. 9 there is shown a modified arrangement of closed carburetor head for replacement of the first described conventional air cleaner housing on the carburetor. In this embodiment the closed head member 84 is mounted in generally sealed relationship on the conventional throat 85 of the carburetor 13. The air ports 60', 62' are provided in the head member 84, above the entry of the fuel-air mixture transmission lines 28', **28*a'* to the carburetor throat, so that the atmospheric air being admitted from the atmosphere to the carburetor throat via the air check valves (not shown) associated with the respective part is admitted above the discharge end of the fuel-air mixture transmission lines 28', 28*a'* to the head. Thus the atmospheric air being applied to the carburetor to lean out the mixture of fuel-air being furnished to the carburetor by lines 28', 28*a'* is entered into the carburetor head above the enriched fuel-air mixture being supplied from the fuming tank. Such a closed carburetor head arrangement will provide slightly greater vacuum to the carburetor upon turning the engine over than say, for instance, the vacuum when utilizing the air cleaner housing member 30 of the FIGS. 3 and 4** embodiment.

From the foregoing discussion and accompanying drawings, it will be seen that the invention provides a novel fuel system for use with an internal combustion engine for generating a fumed fuel-air mixture and for supplying such mixture to associated fuel delivery means of the engine, for ignition therein and which system includes means for causing improved diffusion of the air and fuel, to improve the vaporization process and thus increase the efficiency of the fuel utilized in the engine. The invention also provides a novel fuel system embodying efficient fuming tank mechanism, which is operable to cause an increase of vaporization of the liquid fuel provided, together with means for more completely removing liquid droplets from the fumed fuel, to thus further increase the efficiency of the engine.

The terms and expressions which have been used are used as terms of description and not of limitation, and there is not intention in the use of such terms and expressions of excluding any equivalents of any of the features shown or described, or portions thereof, and it is recognized that various modifications are possible within the scope of the invention claimed.

What is claimed is:

1. A fuel system for use with an internal combustion engine having associated fuel delivery means and fuel ignitable means for power conversion comprising, a containable source for liquid ignitable fuel, a collector means communicating with said source for collecting fuel fumes or vapor adapted to emanate from said source, means communicatable with atmosphere and extending into the container source being operable to transmit air into said source above the pool of liquid fuel therein for generating a fumed fuel-air mixture therefrom, means for transmitting the fumed fuel-air mixture from said collector means to the associated fuel delivery means of the engine for ignition therein, means coacting with the fourth mentioned means and responsive to actuation of the engine, for insertion of liquid ingitable fuel into said fourth mentioned means for intermixing with intake air therein, and means coacting with the fourth mentioned means for diffusing fuel-air mixture from said fourth mentioned means above the pool of liquid fuel in said source upon its entry into said containable source.

2. A fuel system as defined in claim 1 and wherein said fourth mentioned means which is adapted to transmit air into the containable source includes conduit means projecting into said source, and valve means coacting with said conduit means and operable to open to atmosphere upon application of predetermined vacuum to said collector means.

3. A fuel system in accordance with claim 2 and wherein said valve means comprises a normally closed air check valve operable to an open condition in response to actuation of the engine, to enable air to flow into said conduit means, the seventh mentioned means comprising an abutment against which the fuel-air mixture from said conduit means is adapted to impact upon emission from said conduit means, and generally radially directed arcuately extending passageways coacting with said abutment for diffusing the air radially outwardly in generally vortex fashion into the containable source, to enrich the fuel-air mixture with fuel vapor in the containable source and yet aiding in removal of droplets of liquid fuel therefrom prior to the vaporous fuel-air mixture being collected by said collector means.

4. A fuel system in accordance with claim 1 wherein the seventh mentioned means comprises an abutment and coacting arcuate vanes, coacting with said fourth mentioned means to swirl fuel-air mixture when the latter exits from said fourth mentioned means into said containable source.

5. A fuel system in accordance with claim 1 wherein said collector means includes a chamber communicating with said containable source and at least partially enclosing said fourth mentioned means.

6. A fuel system in accordance with claim 1 wherein said means coacting with said fourth mentioned means comprises spray means and adapted for connection with said containable source for the insertion of liquid ignitable fuel from said containable source into said fourth mentioned means responsive to actuation of the engine.

7. A fuel system in accordance with claim 4 wherein said seventh mentioned means comprises upper and lower plates with said arcuate vanes being disposed intermediate said plates and extending generally radially relative thereto, said lower plate providing said abutment for fuel and air entering into said fourth mentioned means for directing such fuel-air mixture laterally via said vanes and said plates in said containable source upon exiting from said fourth mentioned means.

8. A fuel system in accordance with claim 1 including baffle means coacting with said collector means for extracting liquid droplets from the fumes prior to passage of the latter into said collector means from said containable source.

9. A fuel system in accordance with claim 1 wherein said containable source comprises a main chamber for enclosing the liquid ignitable fuel and an auxiliary chamber projecting upwardly above the level of said main chamber and communicating with said main chamber and said collector means.

10. A fuel system in accordance with claim 8 wherein said baffle means is disposed in an auxiliary chamber at the entry of said collector means with said auxiliary chamber.

11. A fuel system in accordance with claim 9 wherein said auxiliary chamber comprises a housing which extends downwardly into said main chamber and including means in said housing communicating said auxiliary chamber with said main chamber whereby liquid fuel can readily pass to and from said housing and into and from said main chamber.

12. A fuel system in accordance with claim 1 wherein said collector means comprises a tubular member which partially encompasses said fourth mentioned means and which possesses a substantially greater transverse area as compared to the transverse area of said fourth means.

13. A fuel system in accordance with claim 1 including a fuel pump, conduit means coupling said containable source to the inlet port of said pump, and other conduit means connecting the outlet port of said pump to said fourth mentioned means and including a fuel mist generating means disposed in said fourth mentioned means comprising the sixth mentioned means whereby liquid fuel from said pump is sprayed into said fourth mentioned means for mixing with air adapted to enter said fourth mentioned means for concurrent projection into said containable source upon actuation of the engine.

14. A fuel system in accordance with claim 1 wherein said containable source comprises a main tank member adapted to contain liquid ignitable fuel therein, an auxiliary tank member mounted on said main tank member and projecting upwardly from said main tank member and extending downwardly into said main tank member, passageway means communicating said auxiliary tank member with said main tank member at the inwardly projecting portion thereof, said collector means communicating with said auxiliary tank member and projecting upwardly therefrom, the seventh mentioned means being disposed in said auxiliary tank member above the level of the top wall of said main tank member, and said fourth mentioned means passing into said collector means above said seventh mentioned means and being coupled to said seventh mentioned means below the connection of said collector means to said auxiliary tank member, said auxiliary tank member and said main tank member comprising a closed housing.

15. A fuel system in accordance with claim 1 including means disposed in said containable source for absorbing liquid droplets of ignitable fuel from the fuel-air mixture prior to its passage into said collector means.

16. A fuel system in accordance with claim 2 wherein said valve means is operable on one pound vacuum pressure.

17. A fuel system as defined in claim 1 wherein said collector means includes coupling means for interconnecting the collector means to transmitting means for transmitting fuel-air mixture from said collector means to the fuel delivery means of the engine.

18. A liquid fuel fume tank adapted for assembly with a main liquid fuel tank for use in an aspiration fuel system for a gasoline powered engine, said fume tank comprising an enclosure adapted to receive in the bottom thereof a pool of liquid fuel, means for transmitting fluid including atmospheric air into said fume tank from exteriorly thereof, means coacting with said transmitting means for insertion of liquid ignitable fuel into said transmitting means responsive to actuation of the engine, dispersing means in said fume tank disposed above the liquid pool level for dispersing the fuel-air mixture from said transmitting means upon exiting into the fume tank, collector means for receiving fuel-air mixture in vapor form from the interior of the fume tank, and means providing for liquid fuel communication between the interior of said fume tank and the interior of an associated main liquid fuel tank for over flow of liquid fuel from the liquid fuel pool.

19. A fume tank in accordance with claim 18 wherein said fume tank includes side wall portion, a top wall portion, and a bottom wall portion, a collector housing projecting upwardly from said top wall portion of said fume tank and communicating with the interior of said fume tank, said collector housing comprising the fourth mentioned means, and means on said collector housing for coupling the latter to conduit for transmitting vaporous fuel-air mixture to fuel delivering means of an associated engine.

20. A fuel tank in accordance with claim 18 wherein said dispersing means includes an abutment against which the fuel-air mixture adapted to be transmitted into the fume tank from the first mentioned means, impacts, and means extending generally radially and coacting with said abutment for swirling the fuel-air mixture interiorly of the fume tank, and so orientated as to swirl the fuel-air mixture above the surface of the pool of liquid fuel in the fume tank.

21. A fume tank in accordance with claim 18 including liquid fuel absorbent means for aiding in the removal of liquid from the vaporous fuel adapted to be received in the fourth mentioned means.

22. A fume tank in accordance with claim 21 wherein said liquid removal means comprises carpet like fabric on the interior sides of said fume tank along which the vaporous fuel is adapted to travel prior to being received in said fourth mentioned means.

23. A fume tank in accordance with claim 19 wherein said collector housing defines a hollow tube and is of curved configuration in side elevation.

24. A fume tank in accordance with claim 23 wherein the distal end of said collector housing is spaced vertically a maximum distance from said top wall portion of said fume tank, and said coupling means is located at said distal end.

25. In a liquid fuel fume tank as defined in claim 18 and wherein said tank includes side wall portions, a top wall portion, and a bottom wall portion, said means providing for liquid fuel communication comprising passageway means disposed in said fume tank and extending through said bottom wall portion, said passageway means being adapted for connection to an associated main fuel tank, and branch passageway means extending from said first-mentioned passageway means interiorly of said fume tank and opening into the interior of said fume tank at a predetermined distance from said bottom wall portion thereof.

26. A fume tank in accordance with claim 25 including a collector member projecting upwardly from said top wall portion of said fume tank and communicating with the interior of said fume tank, said collector member being adpated to receive vaporous fuel therein from the interior of the fuel tank, the first-mentioned passageway means extending upwardly into said collector housing from the underside thereof, and other passageway means extending into said collector housing from exteriorly thereof and emcompassing at least a portion of the first-mentioned passageway means, said other passageway means having valve means coacting therewith operable to open to atmosphere upon application of predetermined vacuum to side tank, and thus connecting the first-mentioned passageway means to atmospheric air.

27. A fume tank in accordance with claim 18 including baffle means coacting with the fourth mentioned means for aiding in removal of liquid from the vaporous fuel.

28. A fume tank in accordance with claim 26 including diffusing means coacting with the discharge end of said other passageway means for diffusing air entering said other passageway means via said valve means.

29. A fume tank in accordance with claim 26 including means for introducing liquid fuel into said other passageway means for intermixing with intake air therein, and including diffusing means coacting with the discharge end of said other passageway means for diffusing fuel-air mixture exiting from said other passageway means.

30. A fume tank adapted for providing vaporous fuel to fuel delivery means of a gasoline powered engine, said tank adapted to receive in the bottom portion thereof a pool of liquid fuel and comprising an enclosure including defining interior side surfaces, means communicatable with atmosphere for generally simultaneously admitting air in combination with a spray liquid fuel into said enclosure, means for removing vaporous fuel from said enclosure for transmittal to associated fuel delivery means of the engine, means coacting with said admitting means for dispersing fuel-air mixture from said admitting means by directing it generally radially outwardly against the interior side surfaces of said enclosure, and means on said interior side surfaces of said enclosure to aid in removal of liquid droplets from the fuel-air mixture as well as aiding in the vaporization of the liquid fuel.

31. In a liquid fuel fume tank as defined in claim 18 and wherein said tank includes side wall portions, a top wall portion and a bottom wall portion, said fume tank being adapted to be fit into a complementary opening in the top wall of a main tank in sealed relation therewith, and passageway means in certain of said wall portions for providing for liquid communication between the interior of said fume tank and the interior of the associated main tank.

32. A fume tank in accordance with claim 31 including a collector housing projecting upwardly from said top wall portion of said fume tank, and means on said collector housing for coupling the latter to conduit for transmitting fumed fuel-air mixture to fuel delivery means of an associated engine.

33. The combination in accordance with claim 32 wherein said collector housing is of arcuate configuration in side elevation.

34. The combination in accordance with claim 32 wherein the distal end of said collector housing is spaced vertically maximum distance from said top wall portion of said fume tank, and said coupling means is located at said distal end.

* * * * *